United States Patent [19]

Tuckey

[11] Patent Number: 4,697,995

[45] Date of Patent: Oct. 6, 1987

[54] ROTARY POSITIVE DISPLACEMENT FUEL PUMP WITH PURGE PORT

[75] Inventor: Charles H. Tuckey, Cass City, Mich.

[73] Assignee: Walbro Corporation, Cass City, Mich.

[21] Appl. No.: 860,866

[22] Filed: May 8, 1986

Related U.S. Application Data

[63] Continuation-in-part of Ser. No. 717,563, Mar. 29, 1985, abandoned, and a continuation-in-part of Ser. No. 642,777, Aug. 21, 1984, Pat. No. 4,596,519.

[51] Int. Cl.[4] ..... F04C 2/10; F04C 15/02

[52] U.S. Cl. ..... 418/15; 418/133; 418/135; 418/171

[58] Field of Search ..... 418/15, 133, 135, 166, 418/171, 180; 417/310

[56] References Cited

U.S. PATENT DOCUMENTS

| | | | |
|---|---|---|---|
| 2,383,153 | 8/1945 | Parsons | 418/135 |
| 2,787,963 | 4/1957 | Dolan et al. | 418/133 |
| 3,045,778 | 7/1962 | Mosbacher | 418/15 |
| 3,526,470 | 9/1970 | Swanson | 418/15 |
| 4,456,436 | 6/1984 | Schillinger et al. | 417/366 |

FOREIGN PATENT DOCUMENTS

| | | | |
|---|---|---|---|
| 57-146084 | 9/1982 | Japan | 418/15 |

*Primary Examiner*—John J. Vrablik

*Attorney, Agent, or Firm*—Barnes, Kisselle, Raisch, Choate, Whittemore & Hulbert

[57] ABSTRACT

A rotary pump for volatile hydrocarbon fuels for use in a fuel system of an internal combustion engine in which a rotor combination has circumferentially spaced areas with ensmalling and enlarging pumping chambers such as a vane pump or a gear rotor pump. To allow purging of vapor from the pump to enable the pump to be self-priming and to pump against a pressurized fuel line under hot fuel conditions, a purge port passage is provided at the circumferential area in which the pumping chambers start to ensmall. This purge port includes a passage leading to the outside of the pump inlet into the body of liquid in which the pump is submerged. Vapor is purged from the pump through this passage to allow normal pumping pressure to develop upon starting of the pump.

3 Claims, 14 Drawing Figures

ROTARY POSITIVE DISPLACEMENT FUEL PUMP WITH PURGE PORT

REFERENCE TO RELATED APPLICATION

This application is a continuation-in-part of my copending application, Ser. No. 717,563, filed Mar. 29, 1985, abandoned and my continuation-in-part copending application, Ser. No. 642,777, filed Aug. 21, 1984, now U.S. Pat. No. 4,596,519.

FIELD OF INVENTION

Electrically powered fuel pumps for installation in the fuel tank of an internal combustion engine.

BACKGROUND AND FEATURES OF THE INVENTION

Fuel pumps utilized for providing hydrocarbon fuels in liquid form to the carburetor or throttle body of an internal combustion system are usually powered by an electric motor in which the armature is mounted in the fuel pump body. These pumps must be capable of operating in a wide range of ambient temperatures.

The hydrocarbon fuels (gasoline and alcohol) have a relatively low boiling point. In certain geographical areas, the ambient temperatures may reach 110° to 120° Fahrenheit. The temperature in the fuel tank below the automotive vehicle may be even higher than this. Since these pumps are frequently mounted in the fuel tanks, there is a great likelihood that the fuel in the pump may vaporize. The pumps are usually positive displacement pumps and it is necessary that the entry to the pump chambers create a low pressure to draw fuel into the pumping chambers.

This reduced pressure alone may cause a change in state of the fuel from liquid to vapor at elevated temperatures and significantly reduce the efficiency of the pump. In another condition as, for example, when a vehicle has been operating and then the engine shut off for a period, the fuel line between the pump and the carburetor or other fuel mixing device is full of liquid fuel under pressure whereas the fuel in the pump can be completely vaporized due to the elevated temperature in the fuel tank and pump itself. Thus, when the engine is restarted, the pump is full of vapor and even the fuel in the entrance filter may be vaporized. The pump cannot, under these conditions, generate enough pressure to move the fuel in the pressurized fuel supply line.

It is an object of the present invention to provide a pump construction with a purging system which will enable the pump to operate under the conditions above described without an interruption of the fuel supply.

It has been previously known to provide a vapor bleed port in a pump at the high pressure area, this port being very small to avoid excessive loss of fuel during normal operation. Also various valving mechanisms have been used to expel vapor during the initial priming stage and to close when liquid fuel reaches the pump. These devices have, however, proved unreliable. For example, the small purge port at the high pressure area may clog with foreign particles and cease to function. In the valve mechanism type, the valves do not always open or close at proper times due to operating environmental conditions. In the present invention the purging is accomplished by establishing a relatively large purge port at a strategic location relative to the pump elements such that vapor will be expelled to the tank and liquid fuel will enter the pump to create the necessary pressure in the fuel line.

It is a further object to provide a purge port which is sufficiently large that it will be self-cleaning and not be clogged by dirt particles and yet will not affect the general efficiency of the pump. In addition, the enlarged purge port is located such that there is a wiping action by the pump elements which provides a self-cleaning function. Another feature lies in the fact that the pumping elements close the purge port part of the time so the efficiency of the pump is not materially affected. A still further object is the provision of a vapor purge system which avoids start delays when the pump is energized.

Other objects and features of the invention will be apparent in the following description and claims in which the invention is described together with details to enable persons skilled in the art to practice the invention, all in connection with the best mode presently contemplated for the invention.

BRIEF DESCRIPTION OF THE DRAWINGS

Drawings accompany the disclosure and the various views thereof may be briefly described as.

Figure 1:
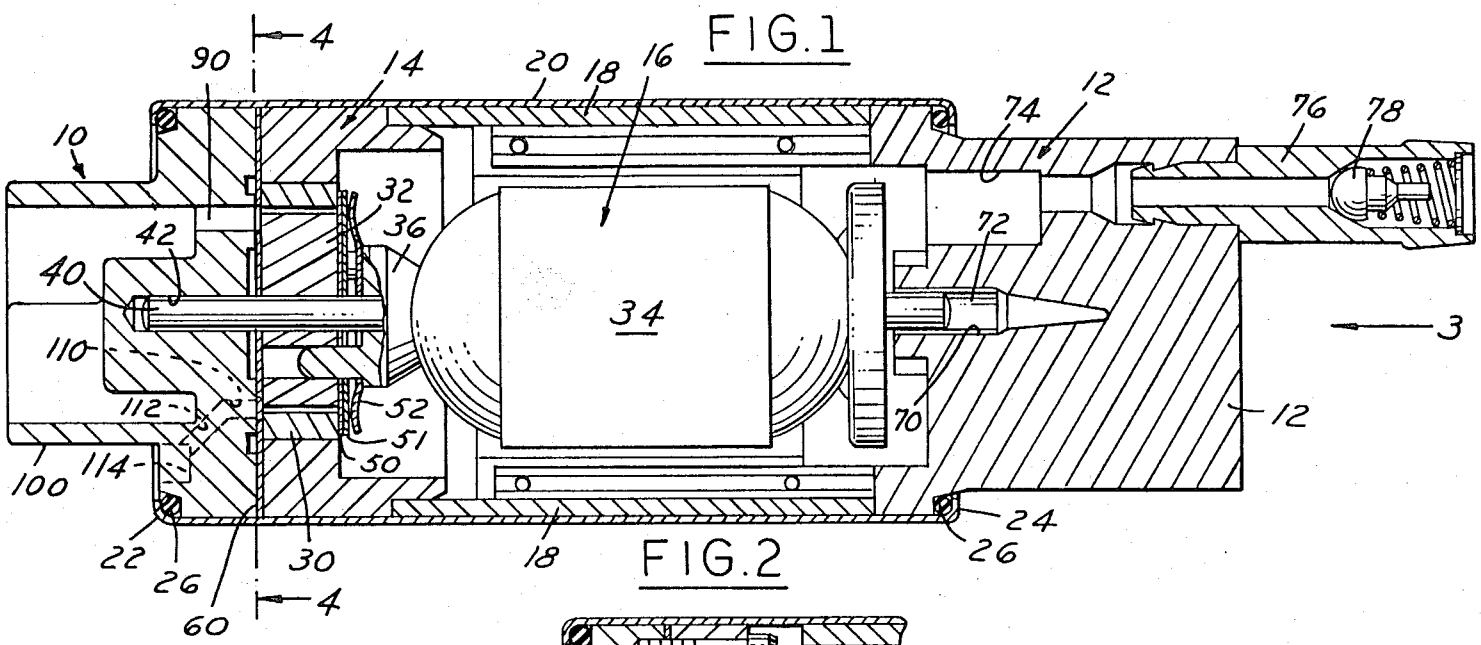
FIG. 1, a longitudinal section of a positive displacement fuel pump.

With reference to the drawings, the longitudinal section of FIG. 1 shows the components of a positive displacement pump essentially similar to that shown and described in my copending application, Ser. No. 642,777, filed Aug. 21, 1984, now U.S. Pat. No. 4,596,519. The attitude of the pump immersed in the fuel of a fuel tank would be essentially vertical with the inlet end, that is, the left-hand end as viewed in FIG. 1, at the bottom connected to a fuel filter.

The basic components of the pump shown in FIG. 1 comprise an inlet housing 10, an outlet housing 12, a pump housing 14, and an electric motor 16 interposed between the housings 12 and 14.

Arcuate flux elements 18 have end-to-end contact with housings 12 and 14 and the entire assembly is contained by a cylindrical sheet metal housing 20 with ends 22 and 24 spun over compressed sealing rings 26. Pump housing 14 has an eccentric recess which houses an outer gear rotor element 30 and an inner gear rotor element 32. The inner gear rotor element 32 is directly driven by a rotating armature 34 which has a drive extension 36 with circumferentially spaced fingers registering with and received in holes in the inner rotor element 32.

A stub shaft 40 in bore 42 rotatably mounts the inner gear rotor 32 and provides a journal for the armature extension 36.

A flexible sheet 50 backed by a second sheet 51 and a spider spring element 52 bears against the rotor elements and rotates with them. A flexible sheet 60 is interposed between housing 10 and housing 14 and overlies the inner face of inlet housing 10 on one side and the gear rotor elements 30, 32 on the other side. The function of these sheets 50 and 60 is described in the above referenced copending U.S. application, Ser. No. 642,777, now U.S. Pat. No. 4,596,519, and will be described herein in reference to FIGS. 8 to 13.

Figure 3:
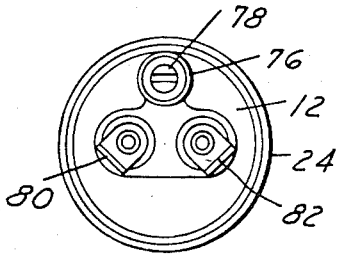
FIG. 3, an end view of the pump outlet at arrow 3 of FIG. 1.

The pump outlet housing 12 provides a bearing recess 70 for a shaft 72 at the other end of the armature 34. An outlet passage 74 leads to a fuel line connector 76 containing an outlet check valve 78 (FIGS. 1 and 3). Also in FIG. 3 are shown electrical connectors 80 and 82 leading to the armature brushes not shown.

Figure 2:
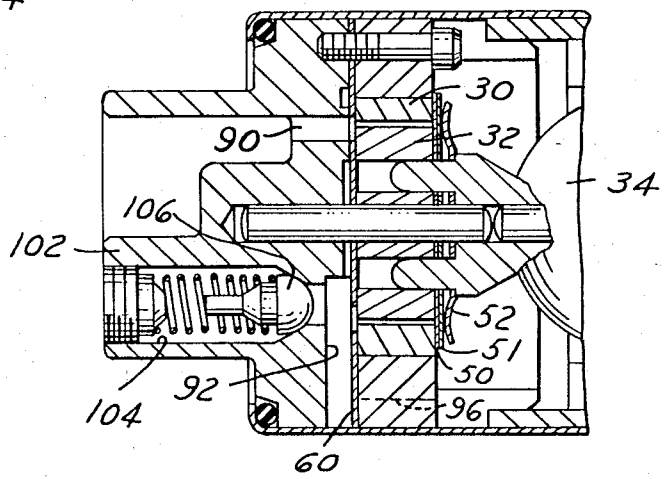
FIG. 2, a second partial longitudinal section of the pump rotated 90° taken on line 2—2 of FIG. 4.
Figure 4:
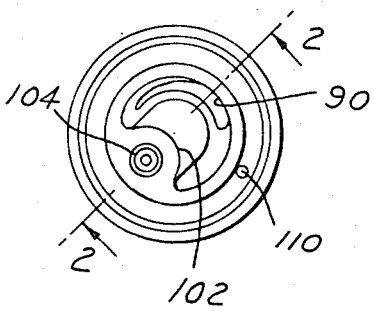
FIG. 4, a sectional view on line 4—4 of FIG. 1.

An arcuate fuel inlet port 90 (FIGS. 1, 2 and 4) overlies that portion of the gear rotor elements where the pump recesses are expanding. Fuel under pressure in that portion of the gear rotor elements where the pump recesses are ensmalling will escape past the flexible sheets 50 and 60. That fuel which flexes or bulges the sheet 50 goes directly into the armature chamber toward the pump outlet 74. That portion which flexes the sheet 60 into a provided pocket 92 flows through the axially extending passage 96 and thence to the armature chamber and outlet 74. This flow is detailed in my copending U.S. application, Ser. No. 642,777, filed Aug. 21, 1984 now U.S. Pat. No. 4,596,519.

As viewed in FIG. 1, the inlet housing 10 has a circular wall 100 which will mount a suitable filter in the fuel tank. An inward bulge 102 (FIGS. 2 and 4) provides a bore 104 for a relief valve 106 which will be-pass pressure to the inlet.

The vapor purge, in accordance with the present invention, is accomplished by providing a passage 110 opening to the inner face of the inlet housing (FIGS. 1 and 4) and angling at 112 to the outer surface of the circular wall 100. A small hole will be punched in the flexible plate 60 to register with the passage 110. A small pocket 114 is provided in the radial face of the inlet housing to prevent possible blocking of the passage 112 by a filter connector mounted on the inlet housing 10.

Figure 5:
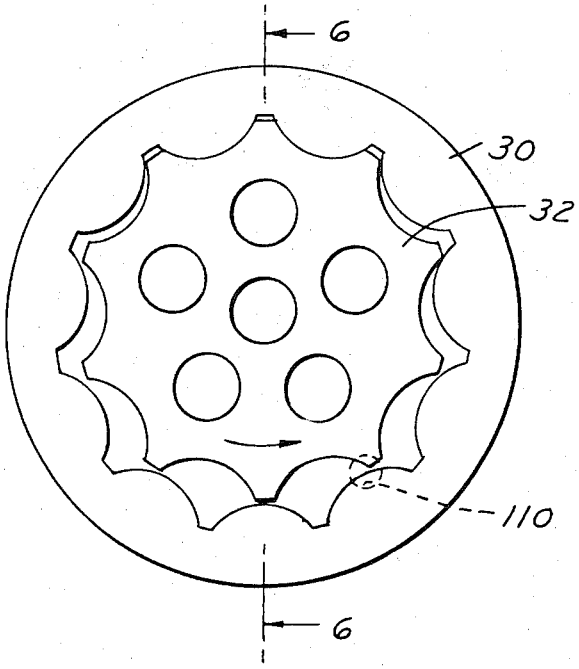
FIG. 5, a view illustrating the inner and outer rotors of a gear rotor pump.
Figure 6:
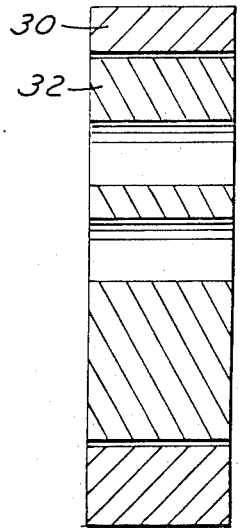
FIG. 6, a sectional view on line 6—6 of FIG. 5.
Figure 7:
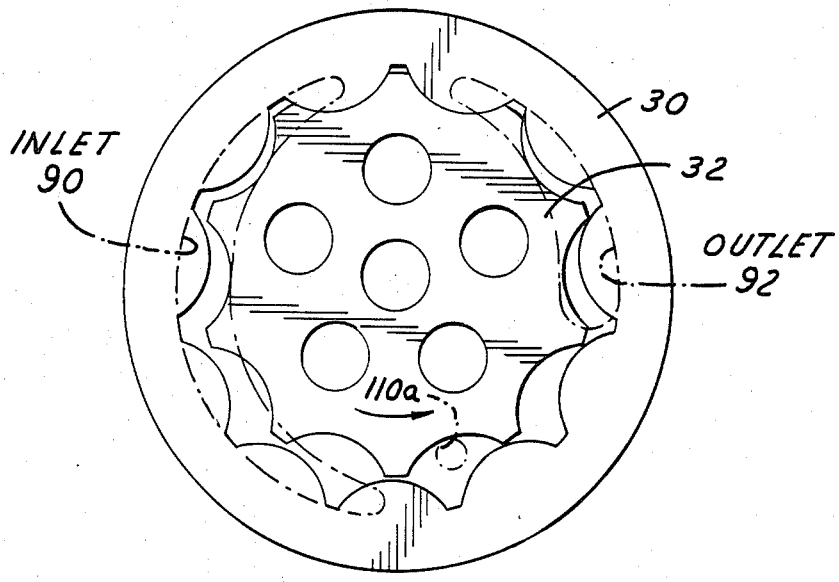
FIG. 7, a view similar to FIG. 5 showing the phantom outline of the inlet and outlet ports.
Figure 7A:
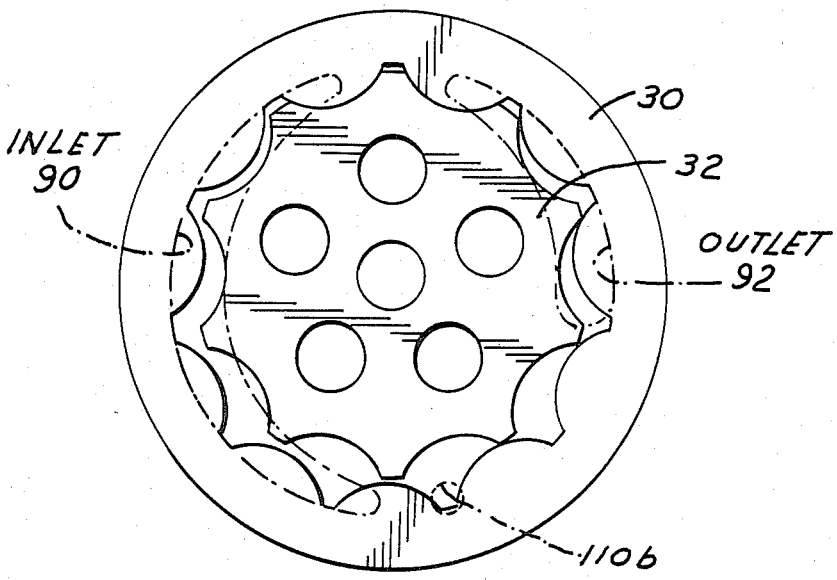
FIG. 7A, a view similar to FIG. 7 showing a modified purge port location.

It will be noted that the port 110 (see FIG. 5) is radially positioned essentially in the sweep of the rotor elements much the same as the inlet port 90 (See FIG. 4) but slightly more toward center. Thus, the lobes of the rotor will move past the port 110 and intermittently open and or restrict the port. The radial location of the purge port 110 is generally midway between the roots of the tooth lobes of the inner and outer gear rotors as the teeth of the rotors pass the purge port. This radial location can be modified to achieve different effects. For example, if the port is moved inwardly 110*a* as in FIG. 7 or outwardly 110*b* as in FIG. 7A from the center position of the pumping elements, the throttling effect of the elements passing the port would increase. The drawing in FIGS. 5, 7 and 7A show the ports 110, 110*a* and 110*b* in different circumferential locations, but this is for clarity only. With a gear-rotor pump, the outside position would provide the maximum throttling effect. The circumferential location of the purge port is determined by the reference to the intake port 90. It is located just past the intake port where the pumping chambers formed by the gear rotors or other pumping elements are starting to ensmall in the compression phase. The angular range for the position of the purge port is about 15° to 60° from the neutral zone position of the pump near the end of the intake zone. In FIGS. 5 and 7, for example, the neutral zone would be directly at the bottom of the pump rotor assembly.

In previous pumps, the purge port generally had a diameter in the range from up to 0.040". This dimension would vary according to the pumping capacity of the pump relative to fuel delivery requirement of the fuel metering system (maximum engine fuel consumption). The purge port 110 according to the present invention may have a diameter ranging from up to 0.090" which is significantly larger in area. This dimension may vary according to pump design but it will be seen that it may be significantly larger than purge ports previously used at the high pressure area of pumps.

The purge port 110 allows vapor in the pumping chambers to escape to the fuel tank early in the compression stage of the pump rotation so the intake port can draw fuel in, thus to facilitate priming. Accordingly, the pump can develop normal operating pressure to prime, when starting initially, and to overcome the stored pressure in the fuel line upon restart. The object of the invention is to facilitate quick priming to obtain the required pumping pressure on hot fuel which is subject to vaporization.

The presence of the purge port in the present invention will not significantly affect pump efficiency. This is due to the fact that the location is at the early compression phase of the pump and also to the fact that at the designated location, the pumping elements, whether they be the lobes of a gear rotor or the vanes of a vent type pump, will cover the purge port part of the time during the rotation.

In FIG. 7 and FIG. 7A, there is depicted a view similar to FIG. 5 with the exception that arcuate inlet port 90 and arcuate outlet port 92 are shown in phantom dotted lines to illustrate the relationship to the purge ports 110*a* and 110*b*.

Figure 8:
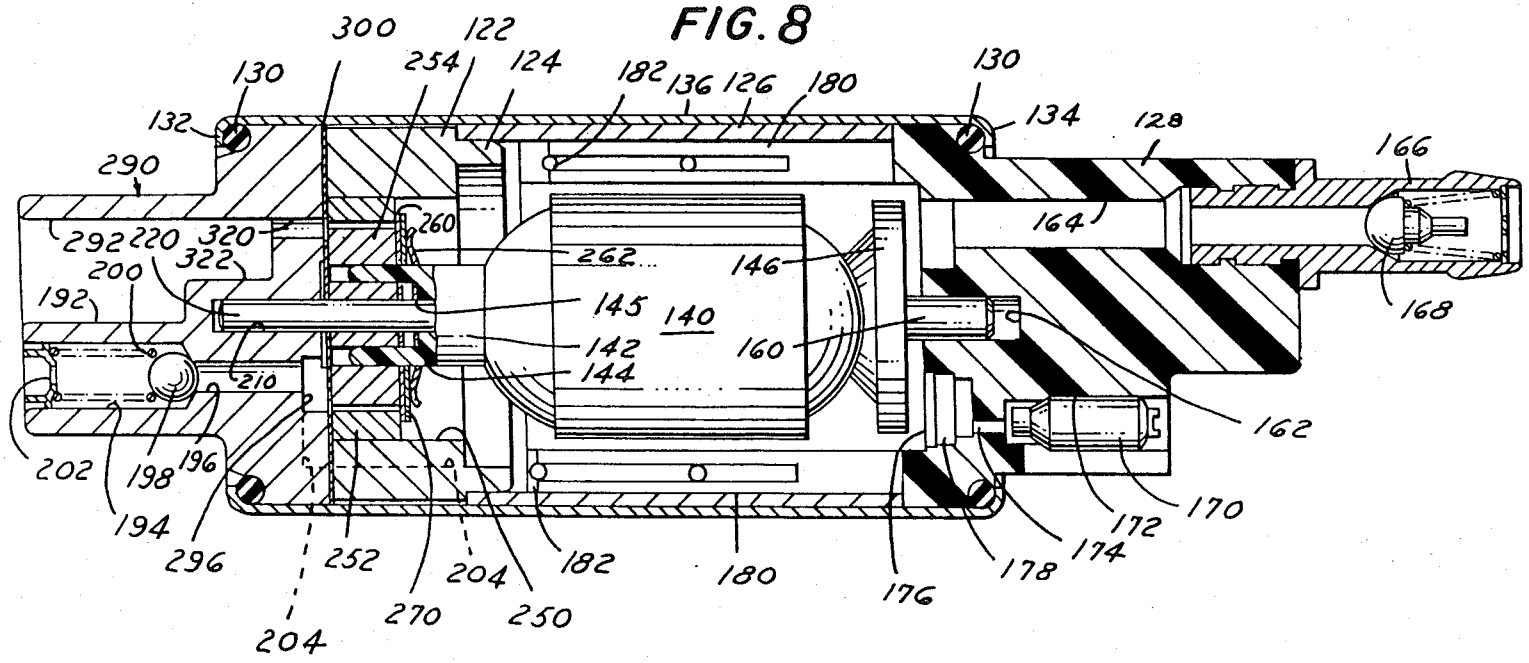
FIG. 8, a longitudinal section of a pump similar to FIG. 1 with a flexible plate on both sides of the gear rotor assembly.

In FIG. 8, another embodiment is illustrated having an inlet housing 290, an outlet housing 128, and an intermediate pump housing 122 encased by a shell 136 spun in at each end 132, 134 around compressed sealing O-rings 130. The pump housing 122 has an annular flange 124 which supports flux rings 126 and a circular opening 250. An armature assembly 140 having a cylindrical drive projection 142 at one end with slender projecting fingers 144 circumferentially spaced around projections 142. At the other end of the assembly 140 is a commutator disc 146. The drive projection 145 has a central bore 145 to receive the distal end of stub shaft 220 which is mounted in inlet housing 290 in a bore 210.

An armature shaft 160 at the commutator end is received in a central recess 162 in the end housing 128 which has an axially extending passages 164 which serves as a pump outlet in conjunction with a brass fitting 166 carrying a one-way, spring-pressed outlet valve 168. A screw outlet bleed adjustment plug 170 is threaded into recess 172 in housing 128 to control a passage 174 leading to the interior of the pump assembly. A filter disc 176 is positioned in a port 178 connecting to passage 174.

The end housing 128 has axially extending split fingers 180 carrying spreading springs 182. These fingers hold semi-circular permanent magnets which surround the armature outside an air gap and form the motor field.

The entrance collar 290 has an axial fuel entry passage 292 and a bulge 192 has a relief passage 194 opening to passage 196 communicating with a pump outlet passage 296.

A check valve ball 198 seats at the juncture of passages 194 and 196 backed by a spring 200 held in by a press-fit retainer 202. Centrally of the collar 290 is a bore 210 mounting a stub shaft 220 which carries the gear rotor assembly 252-254.

Figure 9:
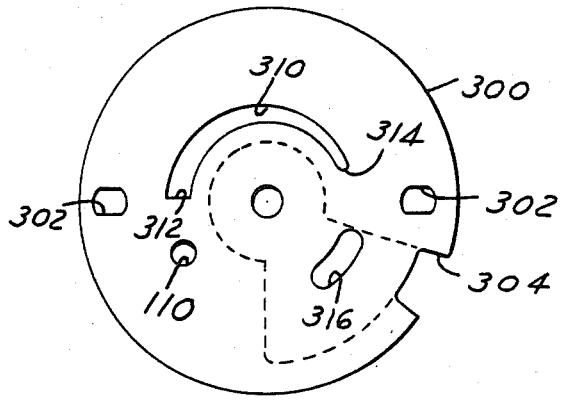
FIG. 9, an elevation of the plate on the intake side of the pump.
Figure 10:
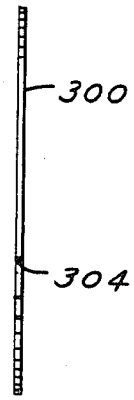
FIG. 10, an edge view of the plate of FIG. 9.

Between the inlet collar 290 and the cam ring 122 is a thin flexible plate 300 shown in elevation in FIG. 9 and in an edge view in FIG. 10. This plate or disc is preferably of the same material as flexible sheet 50 in FIG. 1 and sheet 260 in FIG. 8, namely, a thin metal such as stainless steel or a dense plastic or glass fiber fabric. A Teflon or similar friction reducing coating on the plate is desirable. Behind plate 260 is a reinforcing plate 270 with spaced holes to accommodate the fingers 144. Plate 270 has radial fingers to press on the periphery of plate 260. A spider spring 262 presses against plate 270. It has other functions which will be described. Plate 300 has two diametrically opposed holes 302 to accommodate retaining bolts and an edge notch 304 to register with an outlet passage 204 in the working surface of inlet housing 290. A relatively long arcuate inlet port 310 is disposed outside the center of the plate 300 ensmalling slightly from one end 312 to the other end 314. This port lies radially in the intake area of the gear rotor assembly 252–254. Opposed to the port 310 is a circumferentially short outlet port 316. The neutral zone in this embodiment would be just beyond the end 312 of the inlet port 310. The purge port 110 is shown in FIG. 9 in the neutral zone.

Figure 12:
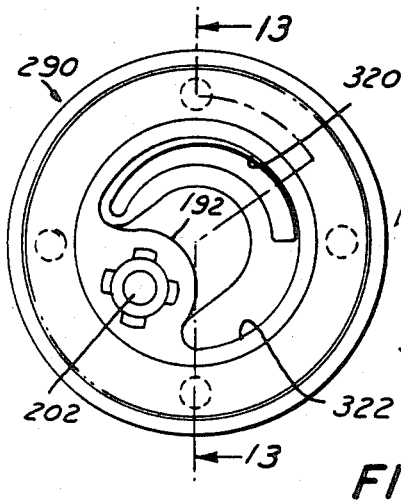
FIG. 12, an outside end view of the end housing of the pump assembly of FIG. 8 at arrow 12 on FIG. 13.

Viewing the inlet collar 290 from the outer end, as shown in FIG. 12, an arcuate inlet port 320 is shown which will register with the port 310 of plate 300 and also with the intake area of the gear rotor assembly. The housing 290 has an arcuate recess 322 leading to port 320 radially about twice the dimension of port 320 and which extends circumferentially from one end of port 320 substantially past the other end of port 320 so that it is almost twice as long as ports 310 and 320.

Figure 11:
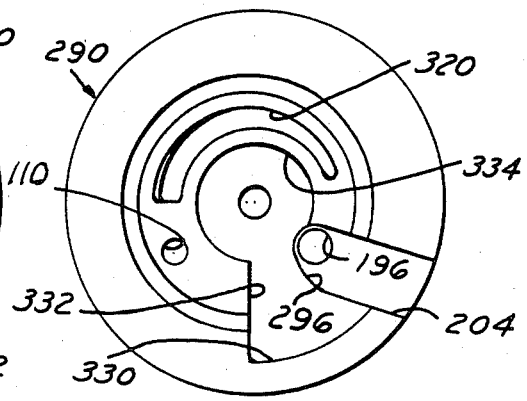
FIG. 11, an inside end view of an end housing of the pump assembly of FIG. 8 at arrow 11 on FIG. 13.
Figure 13:
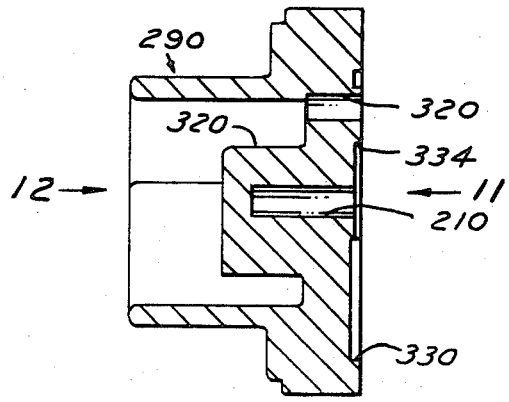
FIG. 13, a sectional view of the end housing of FIG. 8 at line 13—13 of FIG. 12.

Viewing the working surface of housing 290 from the inner pump end in FIG. 11, the arcuate inlet port 320 again appears. Spaced from the smaller end of the inlet port is the outlet port 296 extending radially outward through passage 204 to reach the armature chamber where pump outlet flow ultimately reaches the pump outlet passage 164.

Embossed in the pump face surface of the collar 290 and lying flat against the plate or disc 300 is a shallow recess which has a circumferential boundary 330 terminating at a radial line 332 which joins a central circular line 334 which in turn terminates at port 196 and passage 296.

In the operation, the flexible plate 260 in the operating pump rotates with the pump rotors in a sealing relationship. However, on the pressure side of the pumping elements opposite the inlet port 310, as the pressure develops within the pumping elements 252, 254, the fuel will force the flexible plate 260 away from the outer rotor 252 and enter into the motor armature chamber. Port 316 relieves the pressure within the pumping elements near the end of the pressure zone thereby allowing the flexible plate to reseat against the rotating elements and thus prevent the fuel in the motor chamber from reaching the inlet area of port 310.

It will be understood that pressure in the armature chamber against the seal plate 260 in the outlet zone area will balance the pressure on both sides of the rotating seal 260 to allow the seal to seat against the rotors. The back-up element 270 urges the seal toward the rotors.

The plate 260 also has another function in that, if vapor appears in the pressure side of the pump (cavitation), the pressure in the armature chamber will force the flexing plate back to the rotors and prevent fuel backflow into the pumping chambers. In this manner, it acts as a one-way valve and thus eliminates the noise that otherwise would occur during cavitation.

The fact that the seal plate 260 rotates with the pumping rotors reduces the friction. The plate actually rotates with the inner rotor and only the differential action of the outer rotor is occurring between the outer rotor and the seal plate. This reduces the power needed in the motor and is significant because of the limited dimensions in the rather small pumping element. The power is thus better utilized in the actual pumping of the fuel.

The above arrangement allows the circumferential lengthening of inlet ports 310 and 320 back to the end 312. This is due to the fact that there is a relatively short normally open exhaust port spaced well away from end 312 of the inlet port. Thus, there is no cross-flow between the inlet port and the outlet port. This lengthening of port 310 is very desirable in that it allows the intake function to continue for a longer time duration, thereby reducing cavitation tendencies it the pump.

The function of the wear and seal disc or plate 300 described above can complement the function of the plate 260. This plate 300 is thin and flexible and will move in response to fuel pressure in the outlet area of the pump rotors. To describe this function, reference is first made to the shallow embossed area shown in FIG. 11 defined by lines 330, 332 and 334 and the encompassed area 196 and 296. This area is shown in dotted lies in FIG. 9.

During the operation of the pump, fuel pressure in the arcuate pressure zone of the pumping elements will act against the flexible plate 300 to move it away from the pumping elements in the dotted area shown in FIG. 9. This flexing can take place because of the shallow recess bounded by 330, 332, 344, 196, 296, etc. in the face plate of the inlet housing 290 and may be very slight in range of a few thousandths.

This flexing allows fuel under pressure to reach the normal outlet port 316 in plate 300. This supplements the action of plate 260 because the fuel flowing to the outlet past plate 300 decreases the amount of flexing required by the plate 260. Thus, the two plates 260 and 300 complement each other in providing outlet flow from the arcuate pressure zone of the pump and, at the same time, act as one-way valving for this zone, thus minimizing the backflow in the event of cavitation and serving substantially to reduce the nose of the pump in a passenger vehicle.

I claim:

1. In a rotary pump for pumping a volatile liquid, (a) a rotor combination utilizing circumferentially disposed expanding and ensmalling, positive-displacement pumping chambers, (b) a first circumferential reduced pressure inlet area on said rotor combination, (c) a second cirumferential increased pressure outlet area on said rotor combination spaced circumferentially from said first area, and a neutral zone between said areas, (d) a first means on one side of said rotor combination comprising a stationary inlet housing having an inlet opening at one portion and a face plate at another portion, said face plate lying directly adjacent one side of said rotor combination, said face plate having a passage and connected ports communicating with said inlet opening and with said first circumferential reduced pressure inlet area of said rotor combination, said face plate having also an outlet port at the trailing end of said second circumferential increased pressure outlet area and having a shallow recess open at one side to said outlet port and axially overlying substantially all of said increased pressure area, (e) a stationary outlet housing means forming an outlet chamber on the side of said rotor combination opposite said inlet housing and in communication with said outlet port of said inlet housing, (f) second means closing said pumping chambers on the other side of said rotor combination, (g) power means to rotate said rotor combination and (h) a first thin flexible resilient disc member interposed between said one side of said rotor combination, and said face plate of said inlet housing having a first aperture to register with said inlet opening and said first circumferential inlet area and a second aperture in substantial registry with said outlet port in said inlet housing and a closed portion overlying said shallow recess, whereby liquid pressure developing in pumping chambers in said second circumferential area will move the portion of said resilient plate overlying said shallow recess into said recess away from said rotor combination to allow fluid under pressure to reach said outlet port while preventing backflow of liquid under pressure from said outlet port to the upstream portion of said second circumferential area, (i) said second means closing said pumping chambers on the other side of said rotor combination comprising a second flexible, resilient sealing disc having one surface lying directly against said rotor combination and the opposite surface exposed to pressure in said outlet housing and having a flexible peripheral margin terminating radially outwardly of said pumping chambers, said margin being free to move away from said rotor combination against pressure in said outlet housing in response to higher pressure in said second circumferential area but acting also to prevent backflow of liquid under pressure from said outlet housing, and (j) means forming a circumferentilly localized purge port in said stationary inlet housing and said first resilient disc positioned between said inlet and outlet areas but independent of said outlet port and said shallow recess, and open at an inner end to said rotor combination and at the other end to the outside of said inlet housing to allow vapor in chambers of said rotor combination to be expelled through said port.

2. A rotoary fuel pump as defined in claim 1 in which said purge port is positioned in a range of 15° to 60° past said neutral zone into said second cirumferential area.

3. A rotary fuel pump as defined in claim 1 in which said purge port has a diameter in the range up to 0.090 of an inch.

* * * * *